US005156411A

United States Patent [19]

Owens

[11] Patent Number: 5,156,411

[45] Date of Patent: Oct. 20, 1992

[54] STACKABLE PAINT PAIL FOR ROLLER CADDY AND PAINT SHIELD

[76] Inventor: R. Larry Owens, 2107B Fairway Ct., Conyers, Ga. 30208

[21] Appl. No.: 686,654

[22] Filed: Apr. 17, 1991

Related U.S. Application Data

[63] Continuation-in-part of Ser. No. 335,581, Apr. 10, 1989, Pat. No. 5,046,749.

[51] Int. Cl.[5] ..... B05C 21/00

[52] U.S. Cl. ..... 280/79.2; 280/79.5; 206/518; 118/504; 15/257.06

[58] Field of Search ..... 280/79.5, 79.2, 32.5, 280/47.131; 220/DIG. 12; 206/514, 515, 517, 518; 118/504; 15/257.06, 248 A

[56] References Cited

U.S. PATENT DOCUMENTS

| | | | |
|---|---|---|---|
| 2,763,880 | 9/1956 | Mulcahy | 115/257.06 |
| 2,988,767 | 6/1961 | Tretwold et al. | 15/257.06 |
| 4,164,299 | 8/1979 | Fuhr | 15/257.06 |
| 4,167,271 | 9/1979 | Jorgensen | 280/79.2 |
| 4,258,654 | 3/1981 | Ivankovich | 118/504 |
| 4,325,323 | 4/1982 | Rioux | 118/504 |
| 4,432,161 | 2/1984 | de Bruin | 206/518 |
| 5,046,749 | 9/1991 | Owens | 280/79.5 |

*Primary Examiner*—David M. Mitchell

*Attorney, Agent, or Firm*—Harry I. Leon

[57] ABSTRACT

A stackable, double-walled paint pail having a liquid tight receptacle formed by a generally U-shaped wall and a pair of nearly vertical side walls. The two side walls are spaced from each other by a distance greater than the length of a conventional paint roller. The branches of the U-shaped wall diverge upwardly from each other as do the paired side walls, allowing the pails to be stacked in a compact fashion. Except for the uppermost pail in a stack, each pail is partially disposed within a double-walled structure of the pail immediately above it. Surfaces of the pail across which a roller can be worked include a cylindrically-rounded section at the bottom of the U-shaped wall and a plurality of ridges. The ridges extend horizontally across the inner surface of the upper portion of each branch of the U-shaped wall, forming a pair of washboard-type faces over which a paint-laden roller can be rubbed to coat it evenly with paint. Further, the paint pail has slots for mounting a height adjustable, paint splatter shield and provisions for adding casters to the pail base. The shield includes a flat plate which extends horizontally both rearwardly and laterally from the pail. The height of the plate can be adjusted so that it rides atop any baseboard present and protects both it and the floor from being splattered when the wall above them is being painted.

13 Claims, 3 Drawing Sheets

STACKABLE PAINT PAIL FOR ROLLER CADDY AND PAINT SHIELD

CROSS-REFERENCE TO RELATED APPLICATION

This application is a continuation-in-part of application Ser. No. 335,581, filed Apr. 10, 1989 now U.S. Pat. No. 5,046,749.

BACKGROUND OF THE INVENTION

This invention relates generally to painting equipment and more particularly to roller-type paint applicators.

The use of rollers for painting large areas of flat surfaces such as ordinary dry wall construction enjoys a growing popularity. Paint application using rollers offers two basic advantages over the use of a brush. Specifically, rollers hold more paint and a larger area can be covered with each dipping of a roller into the paint. Further, in most cases, painting with a roller provides a smoother and more uniform finish than does painting with a brush.

Paint roller trays such as that taught by Conner, U.S. Pat. No. 3,110,921, have been very popular with do-it-yourself home owners and others. These paint trays, which are suitable for use by one painter at a time, are inexpensive but awkward, easily tipped over, and difficult to manage when working from a ladder.

A disposable, flexible liner to facilitate the cleanup of a paint roller tray such as Conner's is taught by Bulb, U.S. Pat. No. 3,757,990.

In my prior pending U.S. patent application identified above, there has been disclosed a paint pail of single wall construction having a receptacle with the capacity for holding a gallon or more of paint in which a roller can be quickly, easily and evenly coated with paint. The receptacle is formed by a generally U-shaped wall disposed between and joined to two parallel side walls which extend vertically and are spaced apart from each other by a distance greater than the length of a conventional paint roller. The curvature of the U-shaped wall is such that the roller can be worked across it to remove essentially the last drop of paint stored in the receptacle, conserving paint. In comparison with paint trays now in widespread use, the paint pail allows a substantially greater volume of paint to be held, ready for immediate application. In addition, the placement of ridges on both branches of the U-shaped wall and the divergence upwardly of these two branches allows two painters to rub their rollers simultaneously across the ridges without interference.

In applicant's prior teachings, there is further disclosed a disposable liner for the paint pail. The liner allows one to switch readily from one paint color to another without cleaning the paint pail. The liner can also be used to store unused paint and a roller saturated with this same paint overnight. Once the painting job is completed, cleanup, using the liner, can be accomplished within a few minutes.

In addition, my earlier patent application discloses a paint pail supported by a wheeled caddy on which is detachably mounted an elongated, flat plate. The plate, which is employed as a shield, has a cutout which is dimensioned so that the plate can be fitted closely about one end of the wheeled caddy to keep paint from being splattered on the floor beneath the plate and caddy.

SUMMARY OF THE INVENTION

The subject invention is directed to improvements over applicant's prior teachings by way of modifications in the walls for the receptacle of the paint pail which allow the pail to be stacked with a substantial portion of the receptacle disposed within the receptacle of the pail immediately below it. These modifications save storage and shelf space.

A further improvement is a modification of the pail to include an exterior shell having walls which diverge downwardly from the vertical. The shell and receptacle are joined together to form a double-walled structure. The double-walled structure defines a cavity surrounding the receptacle which is accessible from the underside of the apparatus. Contiguous surfaces of the respective exterior wall of the shell proximate to each branch of the U-shaped wall and of said branch diverge downwardly. Similarly, contiguous surfaces of the respective exterior wall of the shell proximate to each of the side walls of the receptacle and of said side wall diverge downwardly. This divergence is accompanied by an increase in the horizontal cross-sectional area of the cavity surrounding the receptacle from the top to the bottom of the paint pail, allowing a substantial portion of each paint pail to be inserted within the double-walled structure of the pail immediately above it when the pails are stacked.

A still further improvement is the combination, in a single, unitary piece, of the receptacle and of a wall in which is formed a pair of horizontally spaced holes for detachably mounting an adjustable paint splatter shield on the paint pail. This unitary piece eliminates the need for an additional support, such as a caddy, for the paint shield. In the preferred embodiment, the wall in which the pair of horizontally spaced holes is formed is a rear panel of the exterior shield. The shield is preferably an elongated, flat plate with an angle bracket disposed approximately perpendicularly thereto. When mounted on the rear panel, the plate is disposed generally horizontally and extends rearwardly and laterally from the pail. The bracket is attached to the rear panel with bolts inserted into a pair of slots formed parallel to each other in the bracket which can be aligned with the pair of horizontally spaced holes in the rear panel. With the slots, the height of the plate can be adjusted so that it rests atop virtually any baseboard present and can protect both it and the floor from splattering.

A still further improvement is the extension of the base of one of the exterior walls to form a tray as an integral part of the paint pail. The tray is provided to facilitate carrying tools while working at a job site.

As in the paint dispenser apparatus according to the applicant's prior teachings, each of a pair of side walls is sealed to an edge of the U-shaped wall, so that it and the two side walls form a receptacle. A lower portion of this receptacle, which is bounded by the bottom curved section of the U-shaped wall, can hold a substantial amount of paint. Above this lower portion, a plurality of ridges resembling a washboard extend horizontally across the inside surface of at least one branch of the U-shaped wall. Once a roller has been dipped into the paint, the roller can be worked across the ridges to spread the paint evenly on the roller. Furthermore, the walls are high enough to allow vigorous spinning of the roller without causing paint to escape the pail. Each of the ridges protrudes generally downwardly, so that any excess paint tends to accumulate on the edges of the ridges and to drip back into the bottom of the pail. A further object of the present invention is to provide a paint dispenser apparatus with a base on which casters can be mounted, so that the pail can be easily rolled from one location to another.

DESCRIPTION OF THE PREFERRED EMBODIMENT

Figure 1:
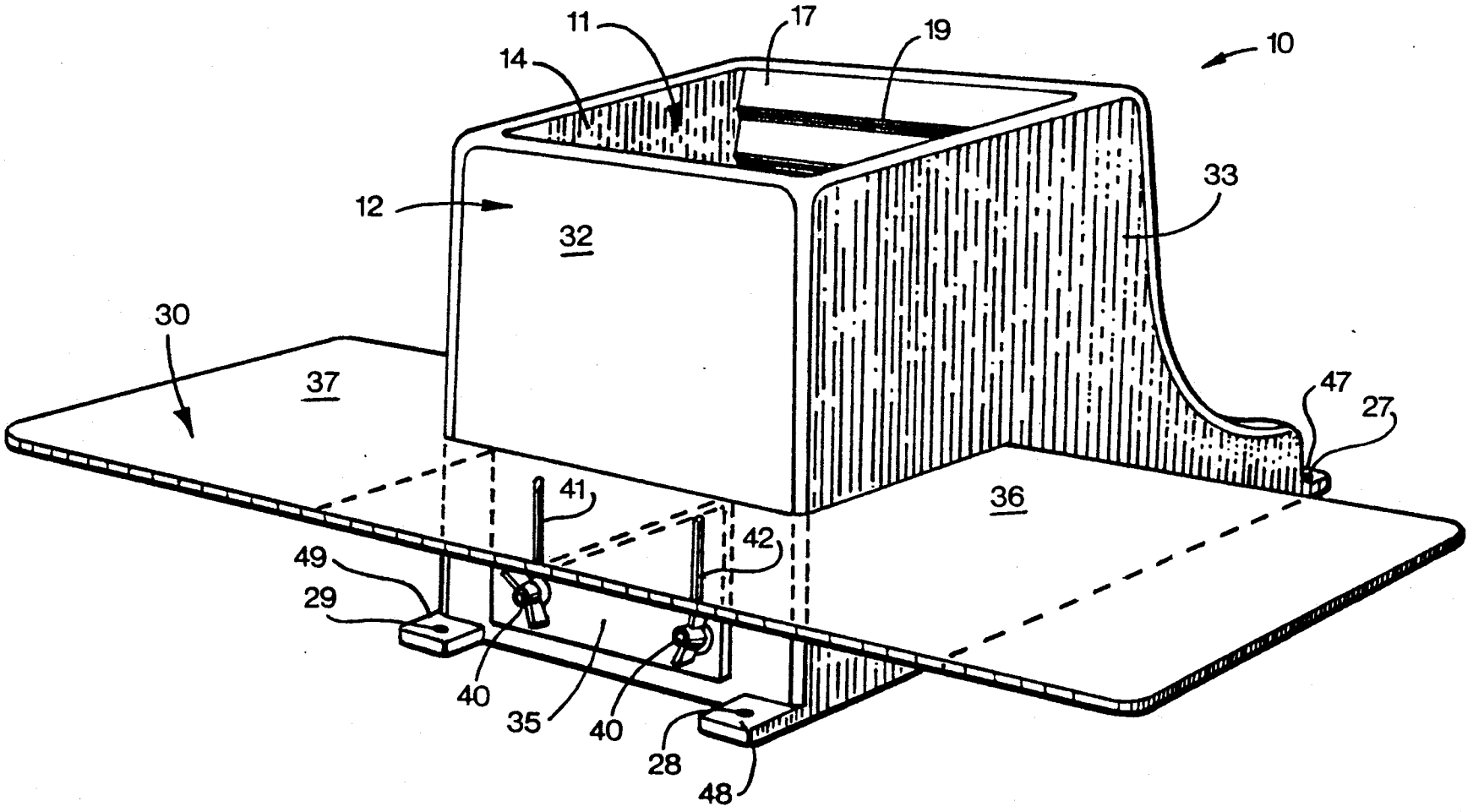
FIG. 1 shows a perspective view of the paint dispenser apparatus according to the present invention in which the paint splatter shield has been attached.

In the drawings, a paint dispenser apparatus according to the present invention is indicated generally by the reference numeral 10. The apparatus 10 comprises a pail with a receptacle 11 having three walls, including a U-shaped wall 13, joined together to form a liquid-tight compartment.

Figure 3:
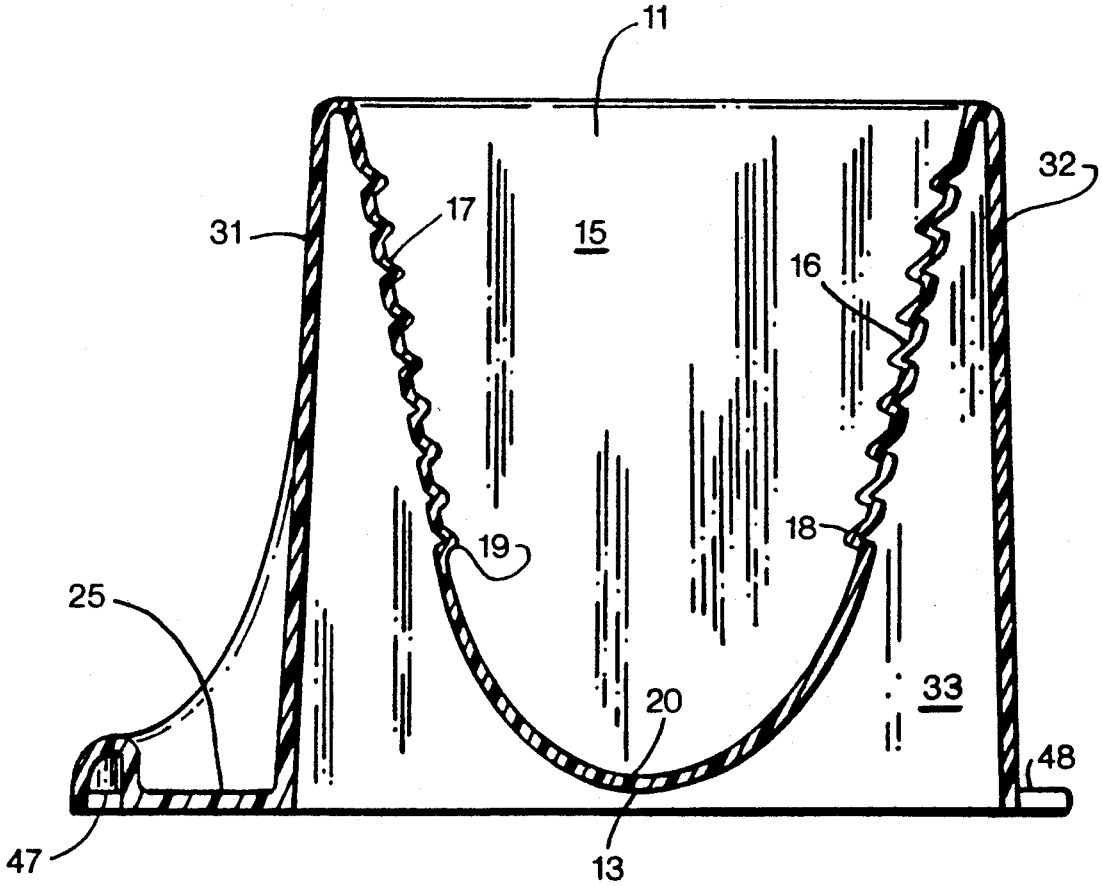
FIG. 3 is a cross-section 3—3, with respect to FIG. 1.

As is illustrated in FIG. 3, branches 16, 17 of the u-shaped wall 13 diverge upwardly from each other. A plurality of ridges 18, 19 extend horizontally across and project downwardly from the inside surface of the branch 16, 17, respectively. Contiguous pairs of ridges 18, 19 are spaced from each other with the sets of ridges on each branch forming a washboard-type surface across which a paint roller can be rubbed. Alternately, ridges are situated on only one of the branches of the U-shaped wall. Any excess paint which accumulates on the ridges 18, 19, as may occur when a roller is being worked across them, tends to drip back into the bottom of the pail. As illustrated in FIG. 3, the ridges 18, 19 can be integrally molded with the branches of the U-shaped wall 13.

Each of the ridges 18, 19 comprises a pair of generally planar surfaces which lie in imaginary planes disposed at an acute angle with respect to each other and which intersect to form the ridge. The upper planar surface of each ridge slopes downwardly, so that paint accumulating on the ridge tends to drip, while it is still wet, from the ridge towards the bottom of the pail rather than flowing over and under the ridges. That is, the dripping paint tends not to cling to the surface of the branches 16, 17 between contiguous pairs of ridges 18, 19 but rather to cascade downwardly from ridge to ridge. Thus the surface area within the paint pail to which any excess paint is exposed, on the average, before it is returned to the bottom of the pail is substantially less than the total surface area of the washboard-type surface of each branch 16, 17, thereby significantly reducing paint waste.

The U-shaped wall 13 further comprises a cylindrically-rounded bottom section 20. The radius of curvature of the section 20 is sufficiently large, and the spacing between side walls 14, 15 sufficiently great, that a user can roll a standard paint roller, which measures, by way of example, 9 inches in length by 2½ inches in diameter, across the bottom of the pail to remove the last drop of paint therefrom.

A disposable, flexible plastic liner (not shown) is preferably used with the apparatus 10 to eliminate the need for cleaning the receptacle 11 between paint jobs or overnight. A suitable liner can be formed from a single sheet of plastic that is folded along a centerline to form a trapezoidal structure and then sealed to liquid tightness along the edges of the trapezoidal structure. In use, the liner is placed in the receptacle 11 and held in position there simply by draping the liner over the top edges of the walls of the receptacle.

The paint dispenser apparatus as thus far described follows the teachings of my copending U.S. patent application Ser. No. 335,581, filed Apr. 10, 1989 and now U.S. Pat. No. 5,046,749.

In accordance with the present invention, the apparatus 10 further comprises an exterior shell 12 and a paint splatter shield 30 detachably mountable thereon. The exterior shell 12 is joined to the upper edges of the branches 16, 17 and to two side walls 14, 15 which, with the U-shaped wall 13, define the receptacle 11. The side walls 14, 15 are spaced from each other by a distance greater than the length of a conventional paint roller, with the spacing between the side walls 14, 15 increasing slightly from the bottom section 20 of the U-shaped wall 13 upwardly. The side walls 14, 15, as well as the branches 16, 17, slope away from each other sufficiently to allow two or more of the apparatus 10 to be stacked without binding. The apparatus 10 are preferably stacked with outwardly facing portions of the walls 13, 14, 15 of a first receptacle 11 being disposed contiguous with inwardly facing surfaces of a second receptacle 11 immediately below the first receptacle in the stack.

The entire apparatus 10 is preferably fabricated from a plastic material; and each of the walls 13, 14, 15 of the receptacle 11 is about ⅛ inch thick. Moreover, in the preferred embodiment, the receptacle 11 measures, by way of example, 15 inches in height and has spans of 13 inches and of 14 inches between the upper edges of the vertical side walls 14, 15 and between the upper edges of the branches 16, 17, respectively. Further, the lowermost ridges 18, 19 in the branches 16, 17 are disposed about 6 inches above the lowest points on the U-shaped wall 13. The lowermost ridges 18, 19 are well above the height to which the receptacle 11 is normally filled with paint.

The capacity of the receptacle 11 can vary over a wide range, but this capacity is preferably at least one quart. For example, in one embodiment, one gallon of paint fills the receptacle 11 to a depth of about 3 inches; and two gallons fills it to a depth of about 5 inches. Not only are the lowermost ridges 18, 19 above the liquid level of the paint in most applications but also the apparatus 10 can be used for an extended period of time between paint refills.

Figure 2:
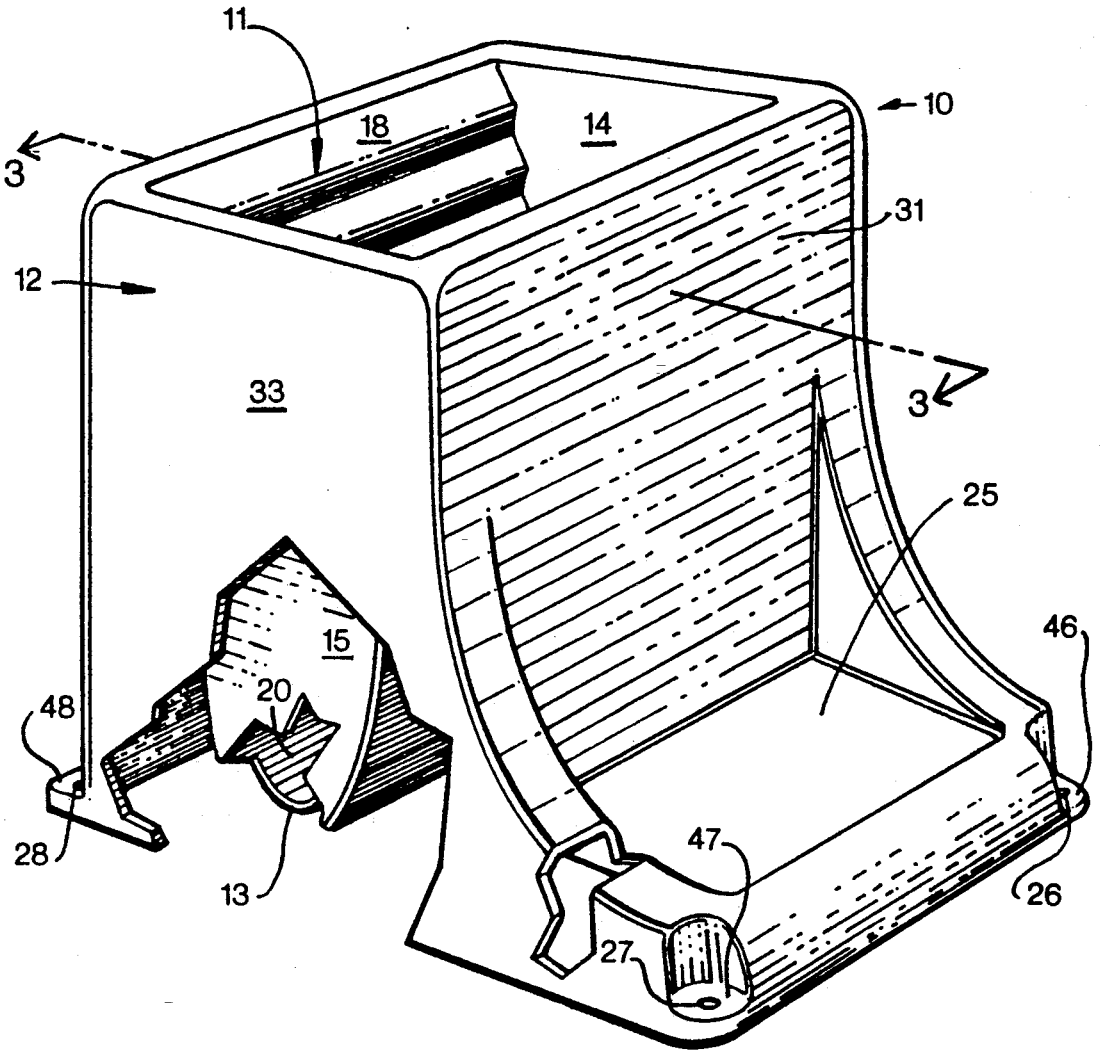
FIG. 2 shows a perspective view of the paint dispenser apparatus according to FIG. 1 but without the paint splatter shield and in which fragmentary sections of the walls of the exterior shell and of the receptacle have been removed for purposes of illustration.

As shown in FIGS. 1 and 2, the apparatus 10 further comprises feet 46, 47, 48, 49, each of which is an integral part of the exterior shell 12 and projects outwardly at a corner thereof. Further, each foot 46, 47, 48, 49 is disposed beneath a recess formed in the shell 12 and defines a hole 26, 27, 28, 29, respectively, which is accessible both from the proximate recess and from the underside of the apparatus 10. Each of the holes 26, 27, 28, 29 is sized for receiving a bolt (not shown) for attaching a caster (not shown) to the shell 12.

The apparatus 10 further comprises a shallow tool storage tray 25 which, in the preferred embodiment, is supported by braces formed by an extension of panels 31, 33 of the exterior shell 12. The tray 25 is useful for holding conventional paint tools.

Opposite the tray 25, the paint shield 30 is detachably mounted on the rear panel 32 of the exterior shell 12

(FIG. 1). The shield 30 itself includes a horizontal flat plate with wide arms 36, 37. Between the arms 36, 37, the plate is connected to an angle bracket 35 which extends at generally right angles to the plate. The bracket 35 defines a pair of slots 41, 42 which can be aligned, over a substantial range of heights of the horizontal plate, with a pair of holes (not shown) formed in the rear panel 32. When the slots 41, 42 are so aligned, bolts 40 held in place with wing nuts can be employed to secure the shield 30 to the shell 12. When the shield 30 is used to protect a high baseboard or molding, the shield is attached to the shell 12 as shown in FIG. 1. Alternately, to protect a low molding or the floor, the shield 30 can be mounted with the angle bracket 35 disposed above the horizontal flat plate. In either case, the wide arms 36, 37 and the section of the horizontal flat plate between them fit closely against the sides 32, 33 of the exterior shell 12 of the apparatus 10.

In the preferred embodiment, the shield 30 is made from ⅛ inch thick plastic and measures, by way of example, 14 inches in width and 40 inches in length. Alternately, the entire shield 30 or parts thereof can be fabricated from metallic material, corrugated paper or the like. The elongated slots 41, 42 in the bracket 35 measure, by way of example, 4 inches in length and are sized to receive bolts 40 with ¼ inch in diameter shanks.

It is apparent from the foregoing that a new and improved apparatus for use in roller painting has been provided. While only the presently preferred embodiment of the invention has been disclosed, as will be apparent to those familiar with the art, certain changes and modifications can be made without departing from the scope of the invention as defined by the following claims.

It is claimed:

1. In a paint dispenser apparatus for use with a roller applicator, the apparatus having a paint pail wherein the improvement comprises:

(a) the paint pail having a double-walled structure with walls defining a receptacle and an exterior shell, the walls of the receptacle and of the shell being joined together near the top edge of the double-walled structure; the exterior shell having at least one flat panel which is spaced apart from the proximate wall of the receptacle downwardly of said top edge;

(b) an elongated, flat structure with at least one straight edge of substantially the same length as the structure; the flat structure having a cutout in the shape of a horizontal cross-section of one end, including said flat panel, of the exterior shell, the cutout being dimensioned to fit closely about said end;

(c) means for attaching the elongated, flat structure to the flat panel so that the elongated, flat structure is disposed generally horizontally; and (d) means for adjusting the height of the elongated, flat structure so that said straight edge can ride atop any baseboard present and can protect both it and the floor from splattering of paint.

2. In a paint dispenser apparatus according to claim 1, wherein the improvement further comprises said exterior shell having a plurality of feet, each foot being adapted for mounting a caster thereon, so that the pail can easily be moved from one area to another without lifting.

3. In a paint dispenser apparatus according to claim 1, wherein the improvement further comprises a tool holder, the holder and the exterior shell comprising a single, unitary piece formed of plastic.

4. In a paint dispenser apparatus according to claim 1, wherein the improvement further comprises contiguous surfaces of the walls of the receptacle and of the shell being spaced apart downwardly from said top edge, the spacing between contiguous surfaces increasing downwardly, the walls of the receptacle and of the shell defining a cavity accessible from the underside of the double-walled structure, so that a substantial portion of the double-walled structure of each paint pail can be inserted within the cavity of the double-walled structure of the pail immediately above it to facilitate stacking the two pails together.

5. In a paint dispenser apparatus according to claim 1, wherein the walls of the double-walled structure which define the receptacle further comprise a pair of side walls and a generally U-shaped wall; both branches of the U-shaped wall diverging upwardly, the side walls being disposed substantially vertically and spaced from each other by a distance greater than the length of the roller, the spacing between the side walls increasing slightly upwardly from the lowermost points on the U-shaped wall.

6. In a paint dispenser apparatus according to claim 5, wherein at least one of the branches of the U-shaped wall further comprises a set of ridges which extend horizontally and which protrude into said receptacle, each of the ridges being further characterized as being formed where a pair of generally planar surfaces meet, substantial portions of the pair of generally planar surfaces forming each ridge lying within a pair of imaginary planes which are disposed at an acute angle with respect to each other, the upper surface of each pair sloping downwardly into the receptacle, so that any excess paint on the branches tends to accumulate on and to drip from the ridges rather than to flow across every exposed surfaces disposed directly downwardly of points on the ridges at which the paint has accumulated.

7. In a paint dispenser apparatus according to claim 1, wherein the improvement further comprises said exterior shell having a plurality of feet, each foot being adapted for mounting a caster thereon, so that the pail can easily be moved from one area to another without lifting.

8. In a paint dispenser apparatus according to claim 1, wherein the improvement further comprises a tool holder, the holder and the exterior shell comprising a single, unitary piece formed of plastic.

9. In a paint dispenser apparatus for use with a roller applicator, wherein the improvement comprises;

(a) a double-walled structure with walls defining a receptacle and an exterior shell, the walls of the receptacle and of the shell being joined together near the top edge of the double-walled structure; the spacing between contiguous surfaces of the walls of the receptacle and of the shell increasing downwardly from said top edge, the walls of the receptacle and of the shell defining a cavity accessible from the underside of the double-walled structure, so that a substantial portion of the double-walled structure of each apparatus can be inserted within the cavity of the double-walled structure of the apparatus immediately above it to facilitate stacking the two apparatus together; the shell having at least one flat panel spaced from the proximate wall of the receptacle;

(b) an elongated, flat structure with at least one straight edge of substantially the same length as the structure; the flat structure having a cutout in the shape of a horizontal cross-section of one end, including said flat panel, of the exterior shell, the cutout being dimensioned to fit closely about said end;

(c) means for attaching the elongated, flat structure to the flat panel so that the elongated, flat structure is disposed generally horizontally; and (d) means for adjusting the height of the elongated, flat structure so that said straight edge can ride atop any baseboard present and can protect both it and the floor from splattering of paint.

10. In a paint dispenser apparatus, the apparatus having an extension and a double-walled structure with walls defining a receptacle and an exterior shell, the walls of the receptacle and of the shell being joined together near the top edge of the double-walled structure; the exterior shell having at least one base, the exterior shell defining means attached to the extension for bracing the extension; the extension and portions of the bracing means being attached to and disposed generally laterally from one of the walls of the shell, the extension being disposed proximate with the base; the bracing means being hollow, contiguous surfaces of the walls of the receptacle and of the shell being spaced apart downwardly from said top edge, the spacing between said contiguous surfaces increasing downwardly, the bracing means and the walls of the receptacle and of the shell defining a cavity accessible from the underside of the double-walled structure, so that a substantial portion of the double-walled structure can be inserted within the cavity of the double-walled structure immediately above it to facilitate stacking the two double-walled structures together; a horizontal cross section of the bracing means increasing downwardly in a direction generally perpendicular to said wall.

11. In a paint dispenser apparatus according to claim 10, wherein the walls of the double-walled structure which define the receptacle further comprise a pair of side walls and a generally U-shaped wall; both branches of the U-shaped wall diverging upwardly, the side walls being disposed substantially vertically and spaced from each other by a distance greater than the length of the roller, the spacing between the side walls increasing slightly upwardly from the lowermost points on the U-shaped wall.

12. In a paint dispenser apparatus according to claim 11, wherein at least one of the branches of the U-shaped wall further comprises a set of ridges which extend horizontally and which protrude into said receptacle, each of the ridges being further characterized as being formed where a pair of generally planar surfaces meet, substantial portions of the pair of generally planar surfaces forming each ridge lying within a pair of imaginary planes which are disposed at an acute angle with respect to each other, the upper surface of each pair sloping downwardly into the receptacle, so that any excess paint on the branches tends to accumulate on and to drip from the ridges rather than to flow across every exposed surfaces disposed directly downwardly of points on the ridges at which the paint has accumulated.

13. In a paint dispenser apparatus according to claim 10, wherein the improvement further comprises said exterior shell having a plurality of feet, each foot being adapted for mounting a caster thereon, so that the pail can easily be moved from one area to another without lifting.

* * * * *